United States Patent [19]

Charles et al.

[11] 4,285,146

[45] Aug. 25, 1981

[54] TAMPER-RESISTANT IDENTIFICATION DEVICE

[75] Inventors: Stanley E. Charles, La Canada; Donald A. Long, Burbank; Arthur H. Schimmelman, Agura, all of Calif.

[73] Assignee: Precision Dynamics Corporation, Burbank, Calif.

[21] Appl. No.: 42,971

[22] Filed: May 29, 1979

Related U.S. Application Data

[62] Division of Ser. No. 702,335, Jul. 6, 1976, Pat. No. 4,221,063.

[51] Int. Cl.[3] ..... G09F 3/14

[52] U.S. Cl. ..... 40/21 C; 24/16 PB

[58] Field of Search ..... 40/2.2, 21 C; 24/16, 24/16 PB, 17 AP

[56] References Cited

U.S. PATENT DOCUMENTS

| | | | |
|---|---|---|---|
| 3,059,359 | 10/1962 | Goldammer | 40/21 C |
| 3,467,246 | 9/1969 | Long et al. | 40/21 C |
| 3,805,427 | 4/1974 | Epstein | 40/21 C |
| 4,078,324 | 3/1978 | Wiebe | 40/21 C |
| 4,154,011 | 5/1979 | Rakestraw et al. | 40/21 C |

*Primary Examiner*—Gene Mancene
*Assistant Examiner*—Wenceslao J. Contrera
*Attorney, Agent, or Firm*—Mahoney & Schick

[57] ABSTRACT

A tamper-resistant, identification device employing a myriad of modes of identifying indicia placement, wherein the device comprises a flexible band having opposed first and second ends wherein one of the ends has at least two apertures and the other end has corresponding rows of apertures wherein by placing the device in encircling configuration, so as to obtain alignment and coincidence of selected apertures, the two ends may be securely fastened together by a variety of fastening means. Additionally, the availability of a choice of identification means and fastening means provides an identification device of high, tamper-resistant character especially useful in high security risk applications. Other selective combinations of identification means and fastening means also provides an identification device which is highly versatile having a plurality of applications of end uses.

7 Claims, 12 Drawing Figures

TAMPER-RESISTANT IDENTIFICATION DEVICE

This is a division of application Ser. No. 702,335, filed July 6, 1976 now U.S. Pat. No. 4,221,063.

BACKGROUND OF THE INVENTION

There presently exists a need to be able to identify a variety of objects, things and personnel by means of an expedient which is easy to use, easy to apply and which offers a myraid of choices in information placement, all in a manner which is economically feasible and which results in identification which is virtually tamper-resistant.

The art has proposed various devices for identification purposes, some utilizing flexible bands having envelopes or pockets in which are contained insert cards bearing printed or typewritten indicia with various means of securing the bands to the objects or persons to be identified.

In some of these prior art devices, tamper resistance is essentially lacking where it is necessary to prohibit unauthorized persons from either switching or changing the identification indicia, i.e. by slitting the information envelope or pocket the indicia may be removed and substituted with other indicia in such a manner that such exchange is relatively undetectable. Additionally, some of the identification devices lend themselves to exchange of information or removal of the identification devices themselves and substitution with another identification device by expanding or stretching the identification device so that it may be exchanged or substituted by unauthorized persons.

For example, and as a specific illustrative example, penal and medical institutions are at present utilizing identification bands or bracelets which are not fully tamper-resistant to the extent that some of the prior art devices may be tampered with to exchange or substitute identifying information or permit complete removal of the identification devices by tampering with the band itself, the identifying indicia or the fastening mechanism utilized to secure the identification devices. It is highly undesirable to permit a situation where the identification devices themselves or alternately the information contained thereon or therein may be altered by unauthorized personnel, either for criminal purposes or for other purposes where such devices are utilized in medical or general applications.

For example, taking the instance of penal use of identification devices, incarcerated prisoners at various stages of criminal proceedings are provided with indentification devices that are fastened or secured to the wrist of an individual upon criminal booking and which serves as indentification means for that particular inmate for subsequent proceedings. That is, the inmate is provided with specific identification which is thereafter utilized in order to accurately identify that individual when that individual is taken from, for example, a holding area of prisoners to appear before a court; identifies that individual through the duration of the criminal proceedings and is also relied upon, with regard to transfer of certain prisoners to other institutions and is even utilized to identify an individual who is to be either released on bond or otherwise set free. It thus becomes encumbent upon officials to be able to obtain accurate identification, expecially where large numbers of prisoners are involved, (as is usually the case in large municipalities, where the number of accused prisoners is large) and the number of police officers is also large and subject to transfer and/or rotation to other duties which prevent normal identification by facial or other physical characteristics.

There are other instances where identification is required which identification should not be easily tampered with or removed, wherein the subject matter to be identified are inaminate objects. Such identification devices should be such that once applied to an object for either warehousing, shipping or other purposes, should not be easily removed or tampered with so as to insure that once the identification process has been accomplished that the likelihood of exchange or substitution of information is unlikely.

In many instances of the prior art devices, information was easily exchanged, the devices were such that they could be expanded so as to permit easy removal as, for example, from the wrist, or alternately utilized securement means which could be easily tampered with especially when considering the large amount of time available to, for example, the hospital patient or a penal inmate. With the herein disclosed invention there is provided an identification device for identifying persons and objects which obviate the aforealluded to shortcomings existing in the prior art. A variety of modes of application of indicia is provided, ease of application of the indicia and a device which is easily applied where, by the construction of the device, tampering with the device is substantially reduced if not eliminated. The devices of this invention all but make it impossible to change identification indicia once put in place and makes it substantially impossible for any undetectable tampering with the securement members or devices themselves making up the construction thereof.

OBJECTS AND SUMMARY OF THE INVENTION

It is an object of the invention to provide an identification device.

It is another object of the invention to provide an identification device of tamper-resistant construction.

It is still another important object of the invention to provide an identification device employing a myriad of modes of applying identifying indicia.

It is still another more important object of the invention to provide an identification device which is strong in construction acting as a deterent with rergard to removal thereof once in place without substantial destruction or mutilation of the device to thereby indicate tampering.

It is still another more specific important object of the invention to provide identification devices of a specific construction utilizing a variety of modes of placement of identification indicia, which is easy to use, to provide tamper-resistant identification.

It is another still even further important object of the invention to provide identification devices wherein said devices are provided with a construction which permits the use of a tamper-resistant indicia and wherein the devices may be selectively sized and permanently secured, the removal of which would require destruction or mutilation of the identification device.

It is still another and still further important object of the invention to provide an identification device utilizing a plurality of sizing apertures, each of which coact witht the securement means to secure the identification device in a tamper-resistant manner.

It is still another and still further specific object of the invention to provide an identification device which has applicability in high security risk environments and which prevents or inhibits the exchange of information on such identification devices or removal and substitution thereof.

It is still another and still further more important object of the invention to provide a mode of identification which allows easy placement of indicia and facile placement of the identification device on the object, person or thing to be identified.

It is still a further more specific object of the invention to provide an identification device comprised of a flexible band having a multiple ply construction wherein elongation of the flexible band is substantially reduced and/or eliminated without detection.

It is still another more specific important object of the invention to provide an identification device of a flexible band nature having spaced apertures on each end thereof wherein the band may be placed in encircling engagement, the apertures of each of the ends placed in aligned coincidence and secured in tamper-resistant fashion by a securement means of selective character.

It is still another even more specific object of the invention to provide an identification device of high strength and of high resistance to removal and/or tampering with the device itself or the identifying indicia carried by the device.

Basically, in an exemplary embodiment, the invention pertains to an indentification device comprising a flexible band of sufficient length for encircling engagement of an object to be identified, wherein the flexible band has a first end portion, an intermediate portion and an opposed second end portion. The first end portion has at least two spaced apertures adjacent the terminus thereof while the second end portion has a plurality of spaced apertures, any two of which are adapted to be placed in aligned coincidence with said at least two spaced apertures in the first end portion. The intermediate portion is adapted to carry indicia in a tamper-resistant manner. Means to securely fasten and retain said end portions in an over-under relationship is also provided wherein the first and second end portions are secured when the flexible band is positioned in an encircling configuration. The securement means is positioned in said at least two spaced apertures and said any two of said plurality of spaced apertures when in aligned coincidence so as to provide tamper-resistant securement.

In other embodiments of the herein disclosed invention, the fastening means are integrally connected to the first end portion of the flexible band and in other instances rows of apertures either in side-by-side, axial relationship or in staggered relationship is provided in the second end portion of the band and adapted for alignment with the apertures in the first end portion so as to be able to receive the securement means once the flexible band is put in encircling relationship.

These and other objects of the invention will become apparent when considering the drawings and the hereinafter following commentary.

Figure 1A:
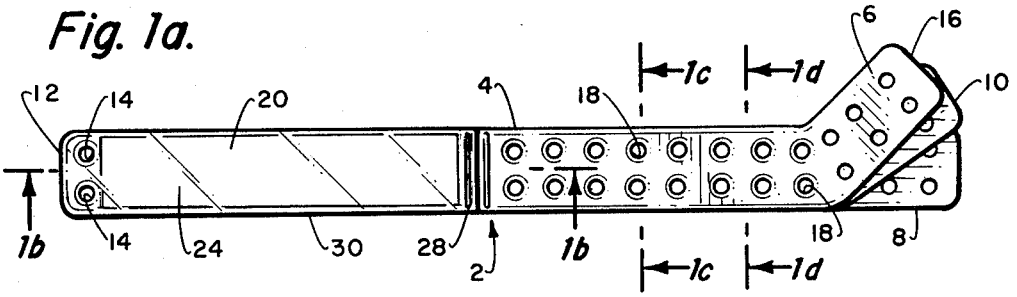
FIG. 1*a* illustrates one of the embodiments of the indentification devices of this invention.
Figure 1B:
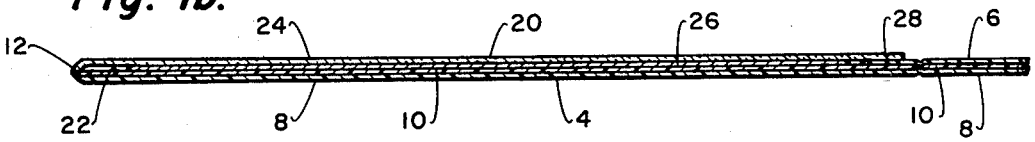
FIG. 1*b* is a view taken along the line 1*b*'—*1b* of FIG. 1*a;*
Figure 1C:
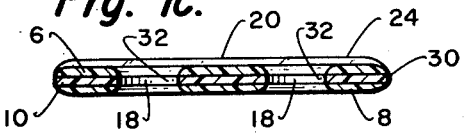
FIG. 1*c* is a view taken along the line 1*c*—1*c* of FIG. 1*a;*
Figure 1D:
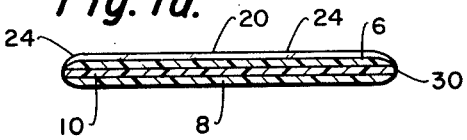
FIG. 1*d* is a view taken along the line 1*d*—1*d* of FIG. 1*a;*

DESCRIPTION OF THE BEST EMBODIMENT CONTEMPLATED:

Before proceeding with a specific description of the invention which for purposes of illustration will be directed to a type of bracelet that finds application in security risk situations, as, for example, may be found in penal institutions or police-type environments, it should be noted that the invention has greater application and field of use and may be employed in non-high risk types of uses, as, for example, may be found in a general hospital. While specifically described with regard to utilization of identification devices for personel, the invention is not to be thusly limited in that the identification devices of this invention are also applicable to identifying objects and things.

Furthermore, before the specific description proceeds, it is well to consider the three essential or salient components of the identification devices of this invention in generic terms, it being understood that the three components are the band, the securement means and the identification means, all of which are selectively variable depending upon ultimate end use to provide an identification device of versatile character.

The Flexible Band

Generally speaking, the size of the identification devices of this invention will be dictated by the end use to which the identification devices are to be put. For example, where the identification devices are to be put in encircling securement on a large diameter object, the length of the flexible band will be longer, whereas if the identification devices are to be utilized to identify patients in hospitals or inmates in penal institutions or similar such uses in identifying human beings and depending upon the plurality of apertures and securement means being utilized, the flexible band will either be longer or shorter or narrower or wider. However, in the typical case where it is desired to utilize a double row of spaced apertures and wherein it is desired to utilize the identification device in encircling securement about the wrist of a human being, the length of the adjustable band will be between $10\frac{1}{2}$ inches and 11 inches although shorter and longer lengths may also be utilized. Additionally, in such an instance, the width of the band may typically be between $\frac{1}{2}$ to 1 inch in width although those of ordinary skill in the art will at once recognize that the foregoing dimensions are in no way delimiting of the invention of the identification devices of this invention.

Briefly alluded to hereinbefore is the fact that the identification devices of this invention are susceptible to various configurations without departing from the essence of the invention in that the herein disclosed structures provide features which ensure the strength and tamper-resistant nature of the identification devices. In the disclosed structures, at least two rows of spaced apertures are utilized in order to provide the high security and tamper resistance necessary in the identification devices of this invention. While the plurality of apertures may be aligned in spaced rows so as to provide two rows, it is of course, contemplated that the spaced apertures may be staggered or aligned in a diagonal with regard to the longitudinal axis of the flexible band. Where the staggered configuration of either two or more apertures is utilized in one of the flexible band ends, the equivalent aperture number and placement must be utilized in the opposing end of the flexible band and the securement means utilized to coact therewitl. accordingly.

In some instances the configuration of the flexible band is so-called straight line or linear whereas in some instances the flexible band will have an L-shaped or flexible tab configuration at one end of the flexible band, the purposes of which will become self-explanatory as the specific description proceeds.

While the identification device of the invention may be individually fabricated, it will be seen from the specific commentary that ideally, it is preferred that a sheet of flexible bands be so fabricated that they are easily removable and separable from the sheet form, the sheet form permitting ease of placement of a plurality of flexible bands in an imprinting means such as, for example, a typewriter, so that upon insertion into a typewriter an individual flexible band may be imprinted thereon and easily removed from the remaining sheets as will become more apparent. In other instances, because of the particular securement means utilized or the specific configuration of the flexible band, it would not be desirable to place the bracelets in an imprinting means such as, for example, a typewriter, but may still be desirable to have such individual flexible bands somehow integrated but easily separable so as to provide an integral sheet which is easily handled.

Generally speaking, the end use to which the identification devices of this invention will be put to will dictate the material from which the flexible band is fabricated and will also dictate the quality of that material. For example, if the identification device is to be utilized with regard to human beings, it is desirable to utilize a material which is of medical grade so as not to be toxic or an irritant to the body of a human being. Generally speaking, the material making up the flexible band may be any natural or synthetic material having a tenacious character. By tenacious is meant the ability to withstand tearing or stretching so as to stand up through the rigors of the intended use of the identification devices of this invention.

The material utilized in fabricating the flexible band should be dimensionally stable in the sense that it has a relatively high modulus of elasticity; a relatively low yield strength; a relatively high ultimate strength and if elongated appreciably, visually indicates such elongation. This lessens the risk of the band being unintentionally or purposely removed from the object or person to which has been secured the identification device.

Particularly suitable materials are plastic materials with or without fibrous components. Satisfactory plastic materials are the poly-vinyl chloride plastics and co-polymers thereof and some of the acetate plastics which are known for their dimensional stability and similar characteristics as for example non-toxicity, softness and other features making their use particularly suitable for association with human beings without adverse side effects.

Of the natural fibrous materials, such materials as resin reinforced papers, plastic coated papers and the like are also desirable but in the synthetic fibrous materials, a satisfactory material made of polyethylene fibers by an integrated spinning and bonding process wherein the fibers are self bonded by heat and pressure to form a synthetic plastic not requiring binders, sizes or fillers and unplasticized, bi-axially oriented poly-vinyl chloride plastics fulfills many of the criteria of the identification devices of this invention.

In most instances, a material thickness of about 4 to 30 mils will provide sufficient strength to the flexible band to insure the tamper-resistant aspect of the identification device. In some instances, the flexible band may be a single ply or layer of material or in other instances, may be comprised of multiple layers. For example, in some instances, a three layer or ply flexible band is desirable in that a single intermediate layer of a self-bonded polyethylene fiber plastic, polyethylene terephthalate resin or an unplasticized, bi-axially oriented polyvinyl chloride layer interdisposed between two synthetic plastic layers will give the strength and tear resistance and tamper evidence necessary for use of the identification devices of this invention in high security risk environments. In other instances, to ensure additional strength, a dual layer of a fibrous intermediate component of the flexible band will be necessary having two outer layer synthetic plastic layers, so as to provide a dimensionally stable, high strength flexible band.

The selection of the materials used in fabricating the identification devices of this invention will be in major part dictated by the end use to which the identification devices will be put and also means or mode of placement of indicia with association with the identification device in that where it is desirable to utilize an identification mode simply comprising the application of ink, the material of the flexible band which is to receive the identifying indicia should be receptive to the particular fluid, ink or dye used in forming the identifying indicia. In other instances where a pocket which is subsequently sealed by heat or otherwise receives imprinted indicia in card form, the type of material of the inner and outer layers or ply will not be as important. These selective aspects of the invention will become more apparent as the specific description proceeds and will also be cognizable by those of skill in the art when considering the end use to which the identification devices will be put. For example, if the identification devices of the invention are to be utilized in a hospital environment or in a penal institution environment, the materials making up the flexible band should be resistant to soaps, water, alcohol or similar such types of fluids and/or chemicals which would normally and naturally be expected to come into contact with the identification device.

THE SECUREMENT MEANS

The securement means, as the flexible band, is highly selectable depending upon the ultimate end use to which the identification device of this invention will be put. The securement means must be such so as to impart a high degree of tamper resistance so that the identification device may not be easily removed without complete or total destruction thereof thereby signaling any tampering.

The types of securement means contemplated include specific designs of rivets and in some instances utilize metal and/or plastic fastening members of the self-locking type which employ a male member and a female member which upon cooperative association, provides a fastener which is highly resistant or tamper proof with regard to effecting disengagement of the male member from the female member. Such types of fastening members are well known in the art and a suitable type of plastic locking securement means found to be suitable is that disclosed in U.S. Pat. No. 3,561,074 for METHOD OF MOUNTING FASTENER COMPONENTS AND CONSTRUCTION THEREOF and U.S. Pat. No. 3,551,963 for SELF-LOCKING SNAP FASTENER. Inasmuch as such fastener components are well known in the art, further detail will not be delved into, but with respect to the unique fastening or securement members which are unique to the practice of the invention, such description will be amplified with regard to the specific description with regard to the figures of the drawings.

The number and type of securement means will of necessity be dictated by the configuration and design of the flexible band of the identification device and as the specific description proceeds it will be obvious that where a multiple aperture is utilized in the flexible band a securement means of multiple character will, of necessity, be required in order to provide adequate and secure placement of the identification device with respect to the object, person or thing to be identified. In the disclosed embodiments, the securement means will be at least of a dual nature so as to provide the strength and tamper-resistant character of the identification devices of this invention.

In other instances where the flexible band utilizes a tab or other than a straight line configuration, the securement means as well as placement with regard to the flexible band will be dictated by these parameters.

THE IDENTIFICATION MEANS

Again, depending upon the end use to which the identification devices of this invention are to be put, the identification means used in conjunction with the identification devices of this invention are susceptible to a high degree of selectivity. In some instances, the flexible band may be formed with a receiving pocket in order to receive inserts to which have already been placed identifying indicia or which subsequently may be acted upon to produce identifying indicia with the pocket opening being inaccessible subsequent to placement of the identification devices in secured fashion. The pocket opening may be heat sealed or adhesively sealed either before or after the identifying indicia has been provided. Obviously, where the pocket concept is utilized, it will be desirable that the upper layer of the flexible band forming the pocket be somewhat transparent or translucent so as to permit easy reading of the identifying indicia.

Also contemplated in the practice of the invention is a flexible band which itself is adapted to receive identifying indicia on the surface thereof or alternately on the interior of one or more plies making up the flexible band. The identifying indicia substances may take the form of inks, dyes and other chemicals or fluids as well as solid compounds which are adapted to produce identifying indicia. The identifying indicia fluids or compounds may also be encapsulated and placed on at least one ply of the material making up the flexible band and thereafter acted upon to produce the desired identifying indicia. Also contemplated are such marking materials as "NCR" paper of the general type disclosed in the U.S. Pat. Nos. 2,299,693, 2,234,862 and 2,730,456 to Green. As is well known in this type of marking system, a marking material, substance or chemical is micro-encapsulated in rupturable capsules and adhered to a surface of a paper sheet or the like which upon the application of pressure ruptures the capsules to allow imprinting or marking of indicia or alternately the inter-reaction of one chemical with another contained on the surface of a juxtapositioned member or layer in order to form the identifying indicia.

The identification means may comprise an area equivalent to the width of the flexible band and may extend in a lengthwise direction a selected degree depending upon the placement and number of apertures utilized in the flexible band. Additionally, the area utilized for identifying indicia may be such as to also provide for the placement of an identifying fingerprint of the ultimate wearer or user of the identification device. In some instances, placement of the fingerprint and identifying indicia directly on the surface of the flexible band with or without subsequent overcoverage with a segment of tape or non-erasable tape will permit viewing of the identifying indicia and will also signal any tampering thereof as by means of erasure and the like. In some instances, the color of the band itself may serve as sufficient identifying indicia.

In all instances, the identifying indicia is such that changing, altering or tampering with the indicia becomes readily discernible and indicates to proper authorities that the identification device has been tampered with.

SPECIFIC DESCRIPTION

Referring to the figures of drawing, wherein like numerals of reference designate like elements throughout and referring specifically to FIGS. 1*a* through 1*d* inclusive, an identification device 2 of the invention is illustrated as comprising a flexible band 4 of straight line configuration comprising a multiply or layer construction. In this particular instance, the flexible band 4 has a first synthetic plastic layer or ply 6 and a second opposed layer 8 with an intermediate layer 10 of high strength characteristic such as biaxially oriented, unplasticized poly-vinyl chloride, polyethylene terephthalate resin or self bonded polyethylene fiber plastics and while one layer 10 is illustrated, in high security risk environments in which the identification device 2 is to be utilized, it may be necessary to utilize a dual stiffening layer so that the flexible band 4 would comprise first and second outer layers having intermediate or sandwiched plural layers.

The flexible band 4 has a first end portion 12 having at least two spaced apertures 14, a second end portion 16 with a plurality of spaced apertures 18 in this instance forming a dual row and the apertures in each of the rows being in spaced alignment and being adapted to coincide with the apertures 14 in first end portion 12 once the identification device 2 has been put in encircling relationship of, for example, the wrist of a prison inmate. Intermediate the ends 12 and 16 is identification area 20 in this particular instance formed as a pocket 22 defined by the upper surface 22 of layer 6 and a transparent plastic layer 24. Placed in pocket 22 is an insert card 26 to which identifying indicia has been typed, written or otherwise placed thereon. In some instances, the insert 26 may be of the type containing micro-encapsulated ink or dye in which event the pocket 22 is sealed as by heat, adhesive or otherwise along the juncture 28. Where the insert 26 has already been provided with the identifying indicia, the insert is placed within the pocket 22 and thereafter the pocket sealed as at the juncture 28. The insert 26 may also be heat sealable or have a heat sealable plastic layer thereon for fusion bonding to the plastic layer 24 and/or the opposed upper surface of layer 10.

In fabrication of the identifying identification device 2, the multi-layers of material may be heat sealed to one another while the apertures 14 and 18 are formed. The peripheral edge 30 about the perimeter of the bracelet and the perimetric area 32, adjacent and forming each of the apertures 18 and 14, are sealed to form an integral structure and to ensure substantial water-resistance of the identification device 2 to prohibit water or other fluid entry, between the layers 6, 8 and 10 making up the identification device 2.

Figure 2A:
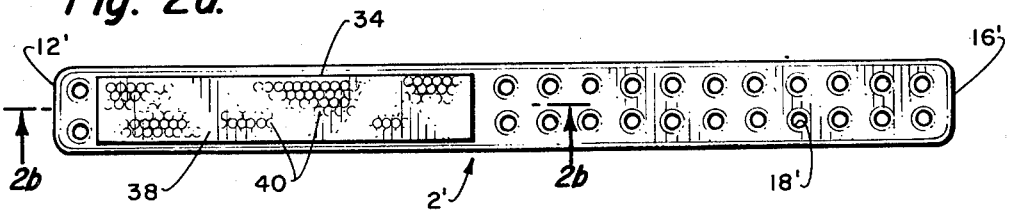
FIG. 2*a* illustrates another embodiment of the indentification devices of this invention.
Figure 2B:
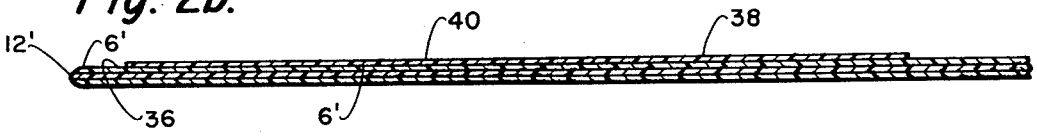
FIG. 2*b* is a view taken along the line 2*b*—2*b* of FIG. 2*a;*

Referring now to FIGS. 2*a* and 2*b*, a preferred type of identification means is illustrated wherein the identification device 2' is constructed similarly to the device 2 illustrated in FIG. 1*a*, with the exception that intermediate the ends 12' and 16' the identification area 34 is itself formed by the upper surface 36 of ply or layer 6' which is absorbent or absorbent to ink, dye or other marking media and which receives imprinted or written indicia directly thereon and has placed thereover a segment 38 either adhesively secured or heat sealingly secured to the surface 36 wherein the segment 38 may be opaque, transparent or transluscent and which segment 38 is not removable once secured to the upper surface 36. In some instances, the indicia may be imprinted or otherwise written directly on the surface 40 of segment 38 which is indicia receptive as described above and which surface may be provided with an erasure-proof underlying design or pattern such as shown in FIG. 2*a*, which inhibits or prohibits alteration of identifying indicia subsequently placed on the surface 40 of segment 38 should erasure or other alteration be attempted.

Figure 3A:
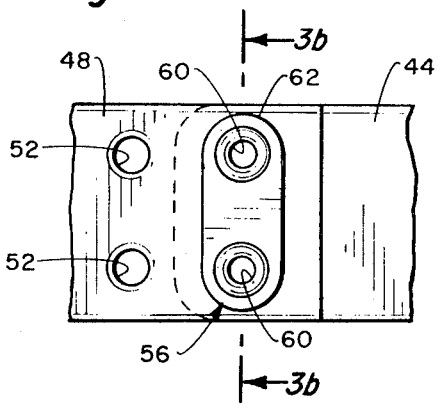
FIG. 3*a* is a fragmented view showing the overlapped first and second end portions of one of the identification devices of the invention.
Figure 3B:
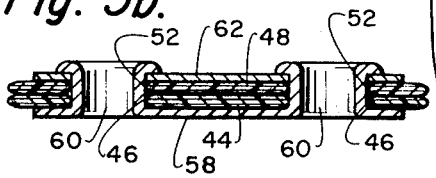
FIG. 3*b* is a view taken along the line 3*b*—3*b* of FIG. 3*a;*
Figure 3C:
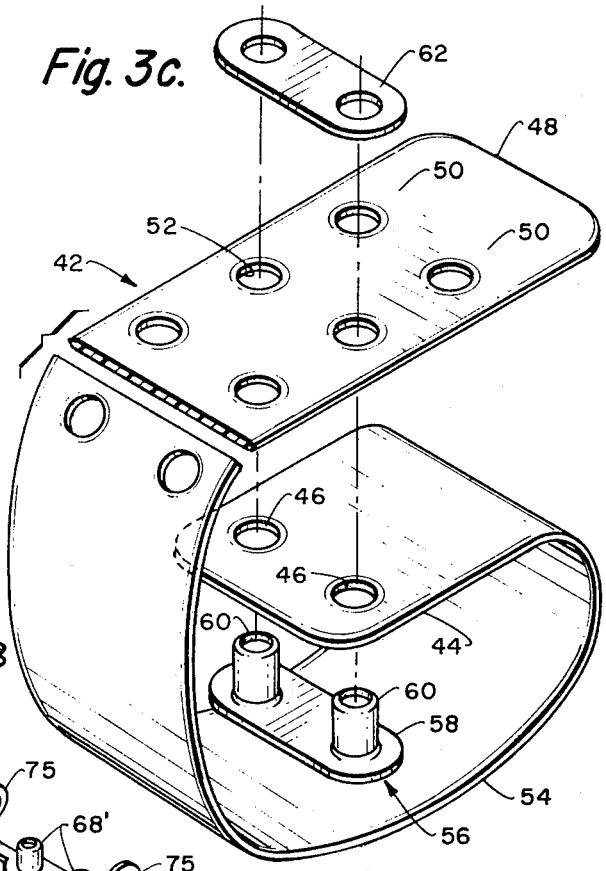
FIG. 3*c* is a perspective, exploded view illustrating one of the identification devices of this invention.

Referring to FIGS. 3*a*–3*c* inclusive, the identification device shown therein and designated 42 comprises a first end portion 44 in this instance having two spaced apertures 46 in direct alignment and having an opposed or second end portion 48 employing the rows 50 of spaced apertures 52, the number of which is dictated by the length of the flexible band making up the identification device 42. The identification means area 54 as well as the layers making up the flexible band portion of the identification device 42 may be as that previously described for FIG. 1*a* and FIG. 2*a*.

In use the flexible band making up identification device 42 and more specifically first end 44, is provided with, in this instance, a dual eyelet fastener 56 of integral construction and comprising a plate member 58 having two spaced male rivet portions 60 of a size and spacing to be received in and through apertures 46 of first end portion 44. Upon placement of the rivet fastening member 56 in the position shown in FIG. 3*c* the second end portion 48 is put in encircling arrangement or configuration with regard to the object or thing which is to be identified and the apertures 52 are selected so as to make the identification device 42 somewhat form fitting around the object or, for example, the wrist of the wearer of the identification device 42 and the male rivet portions 60 are then received through the pair of aligned apertures 52 in the rows 50 and thereafter the upper plate 62 is positioned so as to sandwich the ends 44 and 48 therebetween and to come to rest about the male rivet portions 60 of rivet fastener 56. Thereafter, by utilization of a conventional or specifically designed rivetting tool, the male rivet portions 60 are turned over or deformed as shown in FIG. 3*b* to provide a secure, tamper-resistant fastener which cannot be removed without either destroying the identification device 42 or making tampering therewith self evident. The plate component 58 of fastener member 56 and the upper plate member 62 provide for load distribution and positive captivity of the end portions of the band so as to prevent easy removal or breakage of the flexible band of identification device 42. Once the rivet securement member 56 has been securely positioned, the excess portion of end 48 may be removed as by cutting with scissors or the like. The means of securing the rivet securement member 56 should be self evident to anyone of ordinary skill in the identification device art or for that matter, in the rivetting art in that all that is necessary is to deform the male rivet portion 60 into the configuration shown in FIG. 3*b* of the drawings.

Figure 4D:
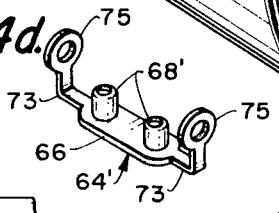
FIG. 4*d* illustrates still another fastening or securement member which may be utilized in the identification devices of the invention.
Figure 4A:
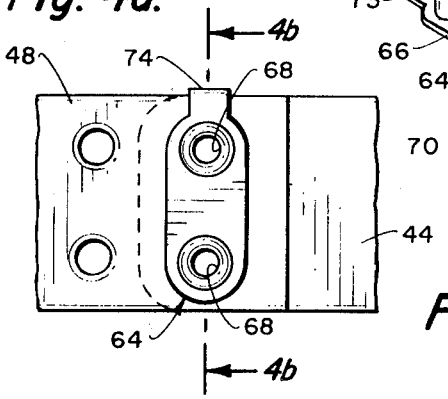
FIG. 4*a* is a view similar to FIG. 3*a* but illustrating an alternate securement or fastening means of the identification devices of the invention.
Figure 4A:
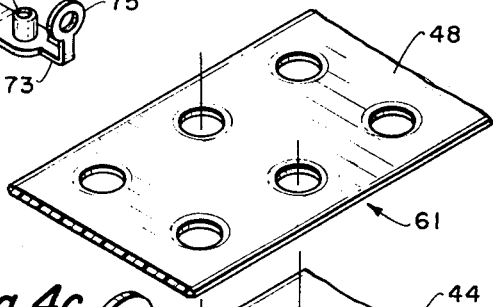
Figure 4C:
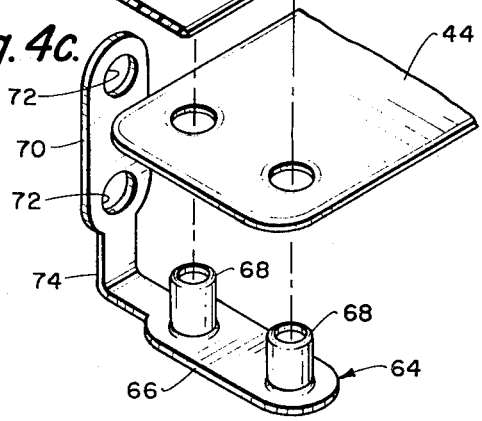
FIG. 4*c* is a partial view of the embodiment of the invention illustrating the securement means or fastener shown in FIG. 4*a;*
Figure 4B:
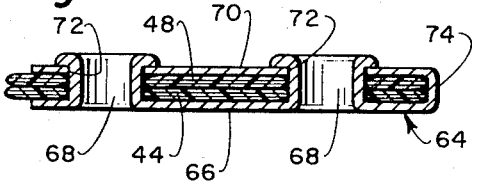
FIG. 4*b* is a view taken along the line 4*b*—4*b* of FIG. 4*a;*

Referring to FIGS. 4*a*, 4*b* and 4*c*, an identification device 61 is illustrated conforming in all structural matters with the identification device 42 previously described but differing in the particular securement or fastening member. In this instance, the fastening means 64 is integral and comprises a plate-like member 66 having upraised male rivet portions 68 and a second plate-like member 70 having spaced apertures 72 with an interconnecting web portion 74 and wherein the fastening member 64 and in particular the connecting web portion 74 is formed of a bendable, deformable metal of high strength material so that the second plate-like portion 70 may be deformed into overlying relationship with regard to rivet studs 68 by the application of finger and thumb pressure for example, and thereafter the male stud portion 68 deformed with the end portions of the bracelet in proper sandwiched relationship into the secured position illustrated in FIG. 4*b*. An alternative form of securement member is shown in FIG. 4*d* wherein the securement member 64' has the first plate member 66' having the integral upraised rivet studs 68' and having interconnected on either side of the plate 66 web portions 73 with upper plate portions 75 to provide the same type of securement as the securement member 64 previously described.

Figure 5A:
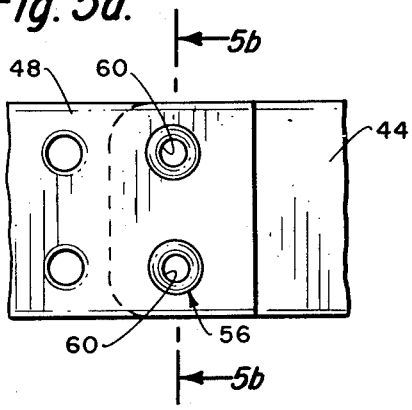
FIG. 5*a* is a view similar to FIGS. 3*a* and 4*a* but illustrating still another fastening securement member of the identification devices of this invention.
Figure 5B:
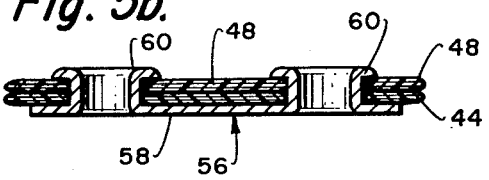
FIG. 5*b* is a view taken along the line 5*b*—5*b* of FIG. 5*a;*
Figure 5C:
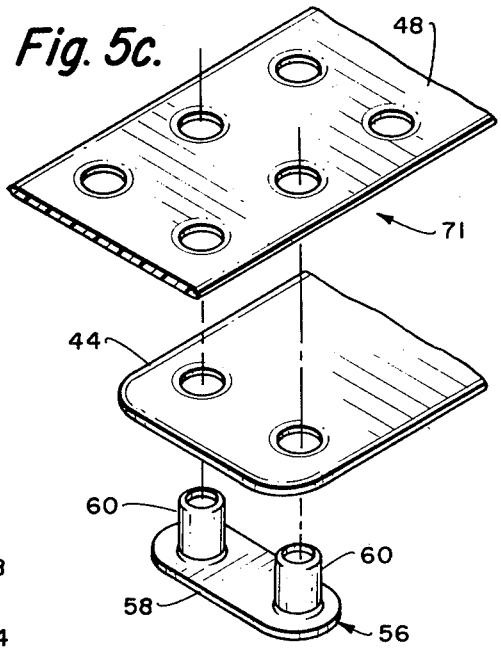
FIG. 5*c* is a partial, exploded view illustrating the application of the securement means to the identification devices of this invention as illustrated in FIG. 5*a;*

Referring to FIGS. 5*a*–5*c* inclusive, an identification device 71 is illustrated which is identical to that illustrated in FIG. 3*c* but differing in the aspect that an upper retaining plate such as 62 is not utilized. In all other respects, the bracelet 71 utilizes the securement means 56 where the male rivet members 60 are ultimately deformed into the secured position as shown in FIG. 5*b* but the rolled under portion being in direct contact with the upper surface of the bracelet end 48 as shown.

Figure 6A:
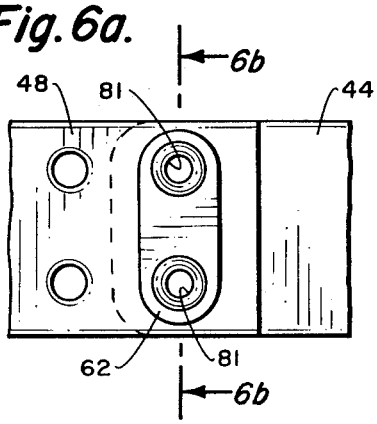
FIG. 6*a* is a view similar to FIG. 5*a* but illustrating still another securement means of the identification devices of this invention.
Figure 6B:
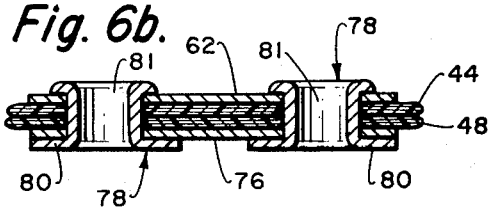
FIG. 6*b* is a view taken along the line 6*b*—6*b* of FIG. 6*a;*
Figure 6C:
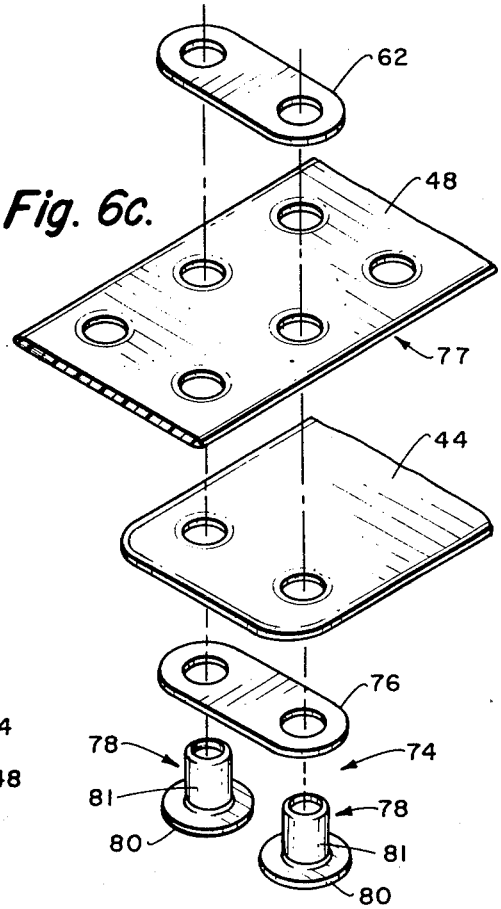
FIG. 6*c* is a fragmented, exploded view illustrating the securement means depicted in FIG. 6*a;*

Referring to FIGS. 6*a* through 6*c* inclusive, a similar identification device 77 is illustrated like that shown in FIG. 3*c* but differing in that in this particular instance, the securement means is slightly changed.

Herein, the securement means 74 employs a separate lower plate 76 identical to an upper plate 62 as utilized in the FIG. 3*c* embodiment and wherein non-integral male rivet portions 78 are utilized having annular cap portions 80 with integral upstanding male rivet portions 81, the use and placement in securement is identical to the securement device 56 previously described with regard to FIGS. 3*c* and 5*c*.

Figure 7A:
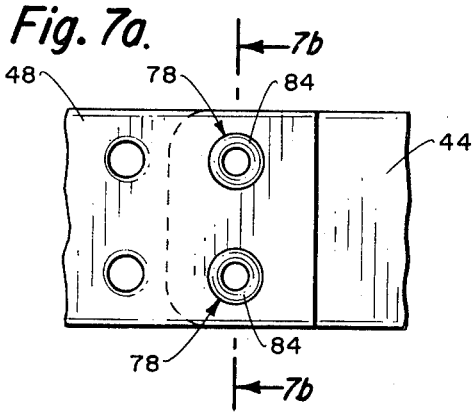
FIG. 7*a* is a view similar to FIG. 6*a* but showing still another securement means used in the identification devices of this invention.
Figure 7C:
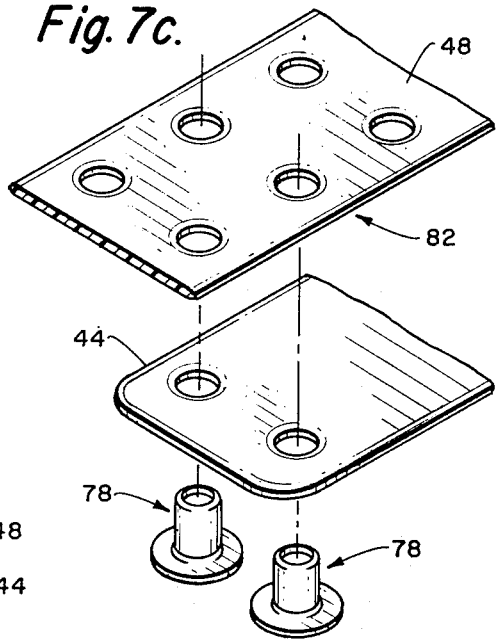
FIG. 7*c* is a partial, exploded view illustrating the securement means depicted in FIG. 7*a;*
Figure 7B:
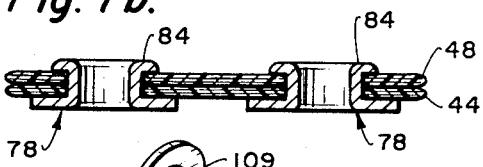
FIG. 7*b* is a view taken along the line 7*b*—7*b* of FIG. 7*a;*

Referring now to FIGS. 7*a*–7*c* inclusive, an identification device or a bracelet 82 is illustrated which is identical in all respects to the identification devices previously described and differs only in the securement means and is most analogous to that depicted and described with regard to FIGS. 6*a*–6*c* inclusive.

In this embodiment of the invention, the male stud members 78 alone are utilized, not having any type of load distribution means such as either of the plates 76 or 62 with regard to previously described embodiments of the invention. In this instance, the rivets 78 are crimped or rolled over as with a rivetting or crimping tool so that the outwardly flared flange portions 84 are in direct contact with the flexible band member making up the identification device 82. While not as strong as the previously described embodiments of the invention in that stress build up adjacent the flared sections 84 may develop, nonetheless, this embodiment provides â device which is tamper-resistant with regard to the end use to which it is to be put.

Figure 8D:
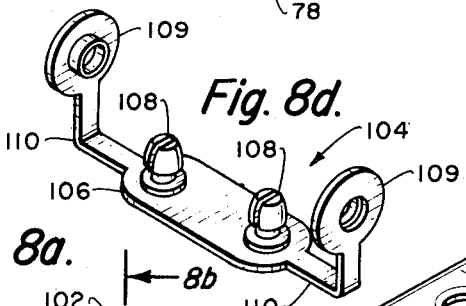
FIG. 8*d* illustrates an alternate embodiment of the fastener means illustrated in FIG. 8*c;*
Figure 8A:
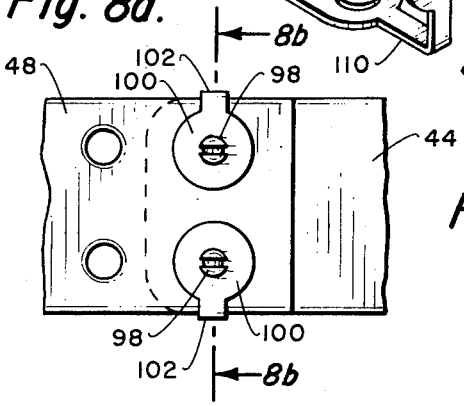
FIG. 8*a* is a view similar to FIG. 7*a* but illustrating still another fastening means utilized in the identification devices of this invention.
Figure 8C:
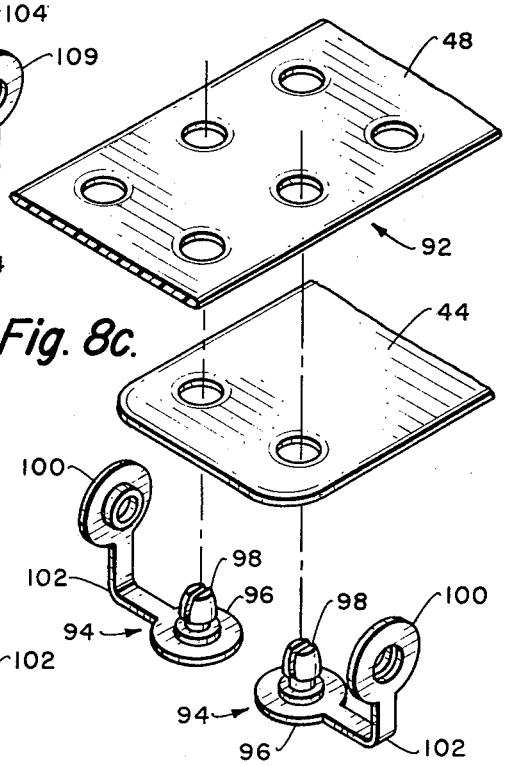
FIG. 8*c* is a partial, exploded view illustrating the securement means depicted in FIG. 8*a;*
Figure 8B:
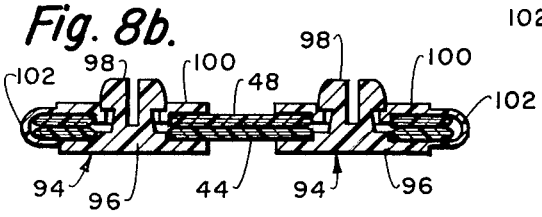
FIG. 8*b* is a view taken along the line 8*b*—8*b* of FIG. 8*a;*

The embodiment depicted in FIGS. 8*a*–8*c* inclusive, illustrates an identification device 92 in this instance having a securement means 94 fabricated of plastic material and of the self locking type wherein each of the fastener members 94 comprises a head portion 96 having a conically shaped male stud portion 98 with a female locking portion 100 connected by means of flexible web portion 102. Obviously, metal and/or plastic fasteners having alternative configurations may be utilized. In use each of the fastening members 94 are positioned as illustrated in FIGS. 8*a* through 8*c* inclusive, with the female portion 100 being moved to overlie the male portion 98 and forced upwardly or downwardly thereon into the locked position as illustrated in FIG. 8*b*. For ease of handling, the securement means may take an integral form such as the securement means 104 illustrated in FIG. 8*d* which has a bottom plate member 106 with two spaced male stud members 108 with female locking portions 109 integrally connected to plate 106 by means of flexible web portions 110. In all instances except those pointed out, the function and securement of securement means 104 is similar to securement means 94 previously described.

Figure 9A:
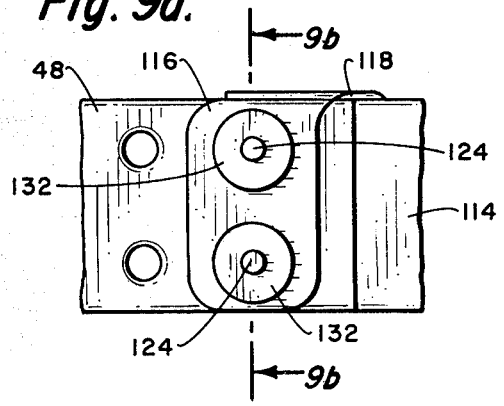
FIG. 9*a* is a partial view of the end portions of still another embodiment of the identification devices of this invention illustrated in the secured position.
Figure 10A:
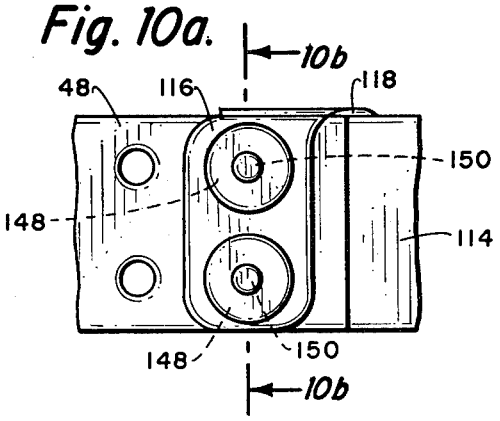
FIG. 10*a* is a view similar to FIG. 9*a* but illustrating still another embodiment of the invention.
Figure 9B:
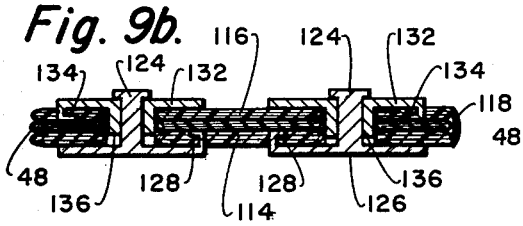
FIG. 9*b* is a view taken along the line 9*b*—9*b* of FIG. 9*a;*
Figure 10B:
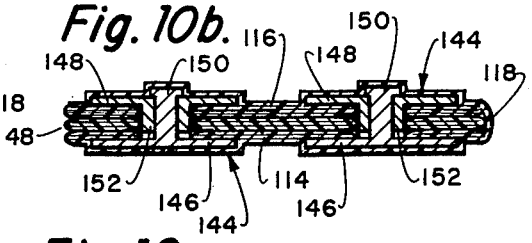
FIG. 10*b* is a view taken along the line 10*b*—10*b* of FIG. 10*a;*

Referring to FIGS. 9*a*–9*d* inclusive, a differently configured identification device 112 is illustrated wherein the flexible band at its first end is provided with a tab. Herein the flexible band 114 is provided with an integral tab portion 116 having a juncture line 118 which allows the tab 116 to be folded over the terminus of flexible band 114 as illustrated in FIG. 9*a*.

In this particular instance, the fastening members 120 comprise metal snap fasteners having a male member 122 having an upstanding stud portion 124 and head portion 126 having spaced barbs or prongs 128 which are bent over or otherwise deformed as by stapling once they have penetrated the material making up the flexible web of identification device 112. The female portion 130 of securement means 120 comprises a head portion 132 having spaced barbs or prongs 134 and having a central female locking collar portion 136 which receives male stud 124 in self-locking fashion and which is not reversible so as to allow disengagement once the male stud portion 124 and female collar portion 136 have been brought into engagement. The securement means 120 as well as its attachment to the band may be any of those presently known in the prior art which have the self-locking feature that is permanent in form and inasmuch as no specific claim is laid to these securement means per se, no further description will be delved into.

Figure 9C:
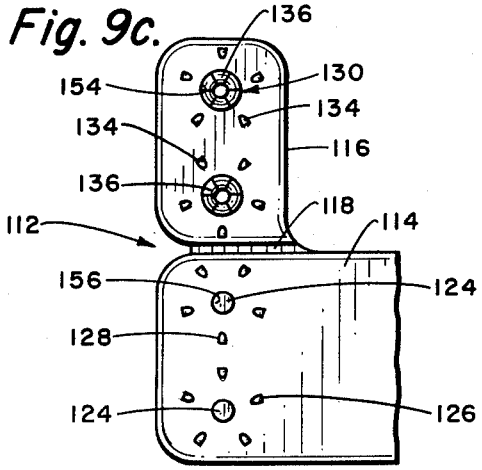
FIG. 9*c* illustrates the one end portion of the embodiment shown in FIG. 9*a* in the open or unsecured position.
Figure 10C:
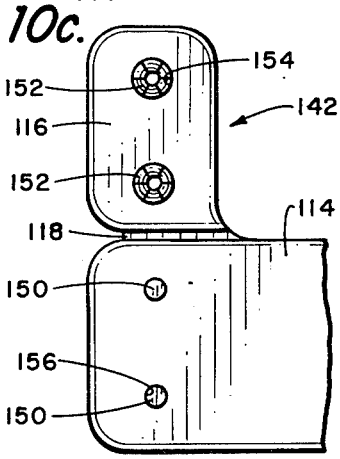
FIG. 10*c* illustrates the one end portion of the embodiment shown in FIG. 10*a* in the open or unsecured position.
Figure 9D:
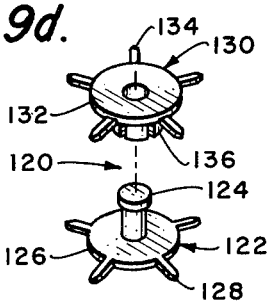
FIG. 9*d* illustrates a securement means utilized in the embodiment of the invention depicted in FIGS. 9*a,* 9*b* and 9*c;*
Figure 10D:
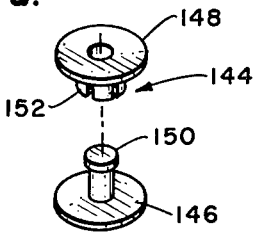
FIG. 10*d* illustrates a securement means utilized in the embodiment of the invention depicted in FIGS. 10*a,* 10*b* and 10*c;*

Suffice to say that in the identification device 112 when the elements of fastener member 120 have been properly positioned, as illustrated in FIG. 9*c*, the tab portion 116 may be brought into overlying relationship of the one end of flexible band 114 once the proper positioning of the other end of the bracelet has been made with regard to the upstanding studs 124 of the male component of the fastener in a manner previously described.

Referring now to FIGS. 10*a*–10*d* inclusive, an identical configured identification device 142 is illustrated which is the same in design and function as the identification device 112 with the exception of the particular securement means utilized. Herein, each of the securement means 144 are of plastic material comprising a male portion 146 and female portion 148, the male portion 146 having upstanding studs 150 which are received in snap acting, self-locking nonreleasable fashion within the female portion 152 of female member 148.

In each of the embodiments illustrated in FIGS. 9*a*–9*d* and 10*a*–10*d*, the respective tabs of the identification devices 112 and 142 respectively may be provided with an annular aperture or hole 154 in order to accommodate in friction fit relationship the female portion of the respective securement means. Likewise, the terminus of the flexible band overlying the tab portions may also be provided with correspondingly aligned apertures or holes 156 so as to receive in friction fitting relationship the upstanding studs 124 or 150 of male components 122 and 146 respectively. In the case of the FIG. 9*a* et seq. embodiment, the respective components of the securement means 120 are secured by means of the prongs or barbs as illustrated, whereas in the FIG. 10*a* embodiment, the components of the securement means 144 may be loosely positioned and retained by the friction fit with the respective apertures or holes, by the opposed annular flanges forming a retaining collar or alternately may be adhesively secured or, since the idendification device 142 is of plastic, may be fusion bonded to the respective tab and end portions of the flexible band making up the identification device 142. Obviously, other fastener components, both metal and/or plastic having alternative configurations, means attachment and function may be utilized in lieu of the specific fasteners described.

Figure 11:
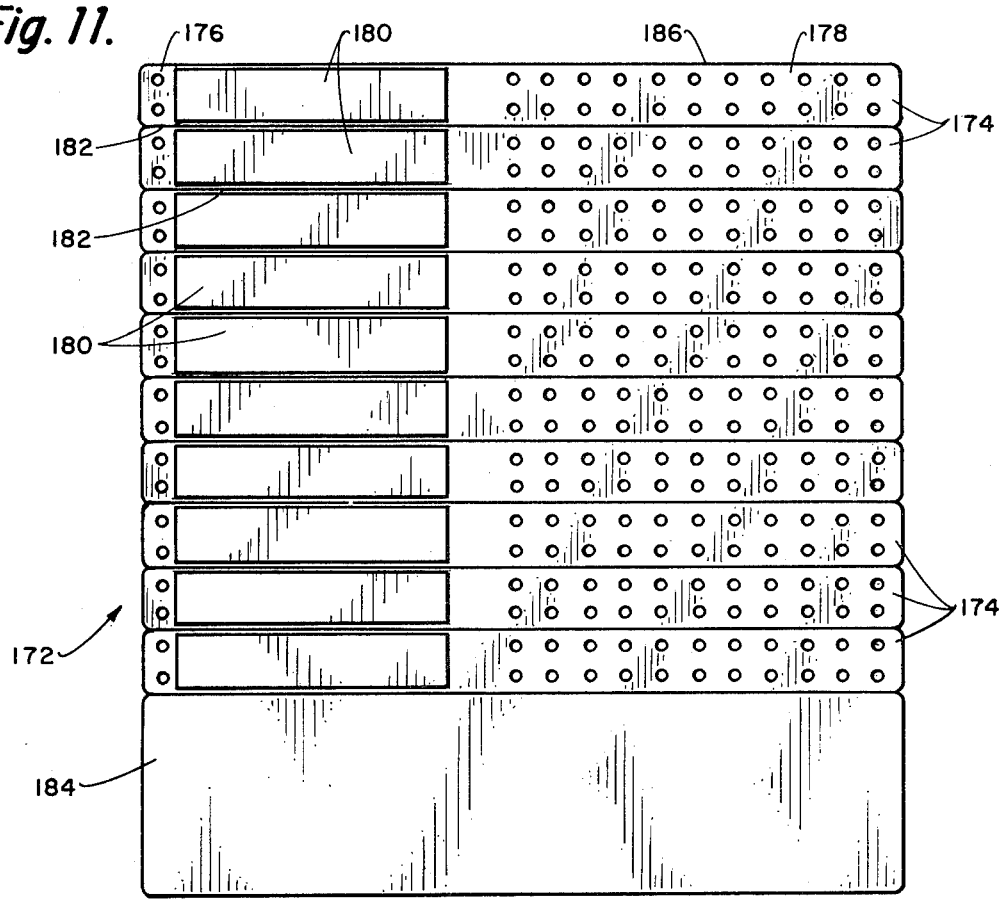
FIG. 11 illustrates another embodiment of the identification devices of this invention in sheetlike form.
Figure 12:
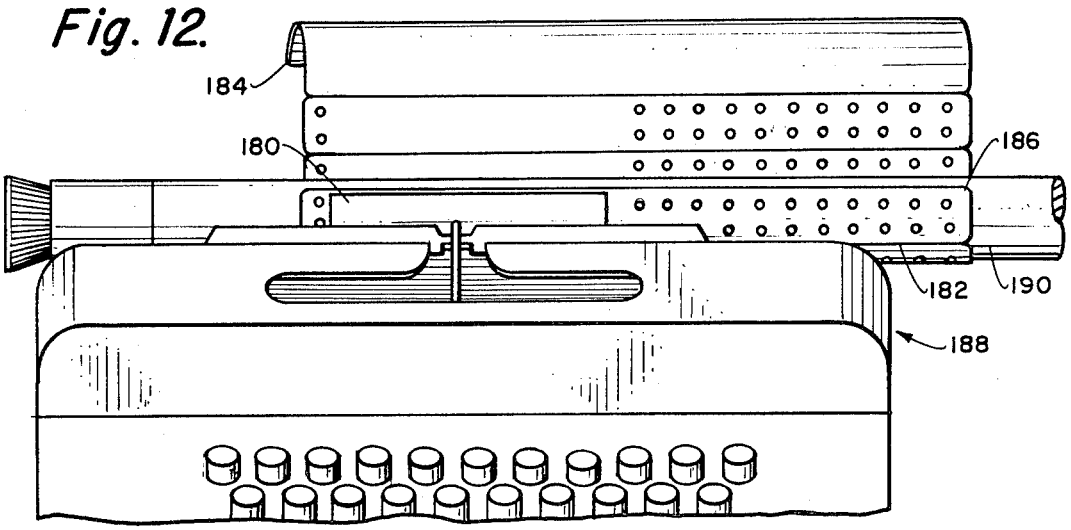
FIG. 12 illustrates how the sheetlike form illustrated in FIG. 11 may be positioned in a typewriter for placement of identification indicia on the one embodiment of the identification device of this invention.

Referring now to FIGS. 11 and 12, means of imprinting with identifying indicia the flexible band of the identification devices of the invention is illustrated. While the straight line or non-tab embodiment is illustrated, it should be obvious that the same mode of application of indicia would apply regardless of the configuration of the flexible band making up the identification device.

Herein, the sheet 172 comprises a plurality of flexible bands 174 each having a first end 176 and an opposed end 178 with an intermediate identification means area 180. The apertures are positioned as has been previously described and each of the flexible bands 174 are fabricated in a manner so as to form a plurality of junctures 182 which is frangible in nature preferably formed by the conventional heat sealing technique so that the individual flexible bands 174 are separable from the sheet 172. The sheet 172 is provided with a blank terminal portion 184 which permits the sheet 172 to be fed by the leading edge 186 into a typewriter, for example, 188 or other imprinting device so that the individual indicia areas 180 may be imprinted upon by means, for example, of the typewriter elements, not shown, of typewriter 188. The width of the blank portion 184 should be such that ample surface contact between the roller 190 of typewriter 188 and the adjacently positioned flexible bands 174 nearest the blank portion 184 is obtained and is frictionally secured in retained position within the feed roll 190 of typewriter 188 during the indicia imprinting process. The sheet form 172 need not necessarily be utilized in an imprinting device such as a typewriter, but may be utilized with any of the previously disclosed indicia means. In such event the sheet form 172 need not utilized or have blank portion 184 However, the sheet form provides a facile mode of handling and storing the identification devices prior to individual separation of the flexible bands for use.

In the form of the invention illustrated in FIGS. 11 and 12, the sequence of utilization of the identification device would be to feed the sheet form 172n into the typewriter 188. The necessary identifying indicia would be typed directly onto the identification area 180 of the flexible band 174 and the typed upon flexible band 174 removed from the remaining sheet and removed from the feed roll 190 of the typewriter 188. Adjacent the type or imprinted indicia, a fingerprint of the individual who is to be identified would be placed on a portion of the identification area 180. A tamper-resistant, nondetachable tape segment may then be placed over the indicia and fingerprint and secured to the flexible band over the indicia and fingerprint by either adhesive or heat sealing. A securement means, for example, taking the form of the dual eyelet illustrated, for example, in FIG. 6*c* would be placed in the one end of the identification device having the two spaced apertures while the other end having the rows of spaced apertures is put in encircling engagement of, for example, the wrist of a person to be identified, the alignment and placement onto the dual studs of the eyelet securement means made, the overplate or flange positioned and the eyelets or rivets crimped over into secured fashion as is illustrated in, for example, FIG. 6*b* and thereafter any excess remaining band, having the rows of apertures, cut off if of excessive length. After this procedure an inmate of a jail, for example, has been provided with tamper-resistant identification means which is of high strength, practically impossible to remove without destruction of the identification device and wherein any attempted alteration of either identifying indicia or fingerprint made all but impossible.

As an example of the identification devices of this invention, particularly useful for high security rink uses such as found in police or penal environments, a flexible band of reinforced medical grade polyvinyl chloride sheet has been fabricated utilizing plasticizers so that the flexible band portion does not become brittle or deteriorate rapidly. The device is of high strength and when attached around an inmate's wrist, the force necessary to rupture the band is in excess of eighty pounds. In order to reduce corrosion or other undesirable side effects the securement means is ideally fabricated of aluminum. The flexible band of the identification devices of the invention are ideally about 11½" long and about 1" wide. A device of these dimensions can accommodate a wrist perimeter smaller than 5½" and is sufficient to accommodate a majority of wrist diameters normally found and may be of different colors for coding purposes to illustrate, for example, the particular seriousness of an offence with which the wearer has been charged or convicted of and provides, once adequately secured, a virtually tamper-resistant identification device which cannot be removed, modified or exchanged without tell-tale evidence of same. To provide additional deterents to tampering, the plate 62, 76 or equivalent securement means components may be color anodized so that tool application will visually be perceptible.

Any attempt to remove the identification device once positioned would entail the use of tools which are not readily available. Any forces applied by tools or other means will produce unmistakable deformations or striations in the band structure which are readily observable and which would signal any possible tampering. Manipulation of the securement means with tools would also be telltaling and indicate tampering especially where color anodizing is utilized. Because of the identification indicia and/or fingerprint and in particular, the utilization of an overlying tamper-resistant tape, any attempt to remove or exchange date with, for example, another prisoner, would be all but impossible without telltaling signs of such actions. Where an adhesive overlying tape is utilized to cover over the imprinted indicia and fingerprint, removal or attempted removal of the tape will leave portions of the underlying bracelet discolored because of solvents in the adhesive layer of the tape. Additionally, the tape may be provided with serrated or notched edges and have frangible portions to make total removal and replacement impossible.

Thus, there has been provided an identification device which is tamper-resistant and which is utilized to securely and positively identify persons, things and objects in a facile manner utilizing one of a myriad of means to obtain identification.

The identification devices of the invention have been described with some particularity but the specific designs and construction disclosed are not to be taken as delimiting of the inventionin that various, obvious modifications will at once make themselves apparent to those of ordinary skill in the art, all of which will not depart from the essence of the invention and all such changes and modifications are intended to be encompassed within the appended claims.

We claim:

1. A plurality of separable identification devices in sheet form, each device comprising a flexible band of sufficient length for encircling engagement of an object to be identified, said flexible band having a first end portion, an intermediate portion and an opposed second end portion, said first end portion having at least two spaced apertures adjacent the terminus thereof, said second end portion having at least two spaced apertures adapted to be placed in aligned coincidence with said at least two spaced apertures in said first end portion when separated from the remainder of said sheet form and said first and second ends being adapted to receive securement means for securely fastening and retaining said ends in an encircling configuration.

2. The identification device in accordance with claim 1 wherein a plurality of said devices are formed in plastic sheet form, each device being separable from the remaining sheet thereof.

3. The identification device in accordance with claim 2 wherein a frangible heat seal juncture boundary is formed between adjacent identification devices of said plastic sheet.

4. The identification device in accordance with claim 3 wherein an edge of said sheet, longitudinal to the axis of any of said identification device is blank and devoid of juncture lines to facilitate retention thereof in an identification imprinting device.

5. The method of identifying which comprises, not necessarily in the order enumerated, the steps of:

a. providing at least one flexible band in sheet form, said at least one flexible band being severable therefrom and having a first end, second end and intermediate portions for carrying identifying indicia, said first and second ends having spaced pairs of apertures therein;

b. associating identifying indicia with said intermediate portion of said at least one of said flexible bands;

c. severing said one of said flexible bands from the remainder of said sheet;

d. inserting one component of a two-component fastener in one of said pairs of apertures in said first end;

e. placing said flexible band in encircling relationship to one to be identified; and f. securing said first end to said second end by inserting said one component of said fastener through a pair of apertures in said second end and installing the other component of said fastener in operative relationship with said first component thereof.

6. The method in accordance with claim 5 wherein the step of associating identifying indicia comprises placement of said sheet form in a mechanical imprinting device.

7. The method in accordance with claim 6 wherein said sheet form comprises at least ten flexible bands and one edge thereof is devoid of flexible bands to form a trailing edge to allow retaining said sheet form in said imprinting device for imprinting seriatim each of said flexible bands.

* * * * *